US005435026A

United States Patent [19]

Cavazos

[11] Patent Number: 5,435,026

[45] Date of Patent: Jul. 25, 1995

[54] MATTRESS CLIP AND MATTRESS

[76] Inventor: Frank G. Cavazos, 14040 Shoshoni Dr., Lockport, Ill. 60441

[21] Appl. No.: 203,063

[22] Filed: Feb. 28, 1994

[51] Int. Cl.[6] ..... A47C 27/04; A47C 21/02

[52] U.S. Cl. ..... 5/475; 5/478; 5/402; 24/72.5; 24/706.1

[58] Field of Search ..... 5/478, 471, 475, 402, 5/409, 259.1, 72.5, 72.7, 706.1, 708.1, 708.3

[56] References Cited

U.S. PATENT DOCUMENTS

| | | | |
|---|---|---|---|
| 825,391 | 7/1906 | Horton | 24/706.1 |
| 879,232 | 2/1908 | Young | 5/259.1 |
| 2,086,767 | 7/1937 | Haas | 24/706.1 |
| 2,180,500 | 11/1939 | Bernstein | 5/475 |
| 2,567,550 | 9/1951 | Clark | 5/478 |
| 2,639,764 | 5/1953 | Fernberg | 5/409 |
| 3,293,670 | 12/1966 | Anson | 5/475 |

*Primary Examiner*—Flemming Saether
*Attorney, Agent, or Firm*—Ernest Kettelson

[57] ABSTRACT

A mattress clip to secure the fabric flange of a mattress cover to adjacent springs of the innerspring assembly, such clip having a hook end, a short lateral leg extending therefrom to an integrally formed single loop having a narrow but resiliently expandable entrance to receive and hold the ring of an adjacent coil spring therein, a longitudinal leg extending therefrom to an integrally formed double loop, a return longitudinal leg extending therefrom to terminate in a sharply pointed end adjacent the hook for reception therein after the return longitudinal leg with the sharply pointed end has been passed through the fabric flange of the mattress cover. Such clips enable an end use customer to assemble a mattress from component parts, including the innerspring assembly, then placing insulating and cushioning pads thereon which are secured to the springs by the mattress clips, finally placing the outer mattress cover with fabric flange over the insulating and cushioning pads and securing such flange to the springs by the mattress clips. The peripheral border strip is then secured around the peripheral side wall of the mattress by a zipper assembly or hook and loop fastener strips around the upper and lower peripheral edges of the border strip, or by a zipper assembly or hook and loop fastener strips around one of such peripheral edges and by permanently securing the other peripheral edge to the adjacent peripheral edge of the mattress cover.

11 Claims, 3 Drawing Sheets

MATTRESS CLIP AND MATTRESS

BACKGROUND OF THE INVENTION

This invention relates to the field of fastening devices which fasten the various fabric, insulating and cushioning components of a mattress to its innerspring assembly, and to the assembled mattresses when such fastening devices are used.

Prior art fastening devices presently used to fasten the fabric, insulating and cushioning components of a mattress to the innerspring assembly are known as hog rings. They comprise a strip of metal bent in a sort of triangular shape in which the opposite ends of the metal strip that will form the third leg of the triangle are initially spaced apart to receive whatever the hog ring is to be fastened to, whereupon a tool similar to a pair of pliers is used to press the two opposite ends together. The original purpose of hog rings was and is to clip them to the snout of hogs when they are relatively young to deter them from rooting in the earth. When hog rings are used to secure the insulating layers, cushioning layers and mattress covers to the innerspring assembly, the portions of such components adjacent a spring are gathered between the spaced apart ends of the hog ring, pressed against the facing portion of an adjacent coil spring, and the hog ring tool is then applied to press the ends together thereby clipping and fastening the respective mattress components to the innerspring assembly.

Other prior art fastening devices of which the applicant is aware are in somewhat related fields such as the upholstery field, drapery field and the like. They include those which are described and shown in the following United States patents.

U.S. Pat. No. 2,556,400 discloses a wire drapery hanger having an inverted V-shaped clamp portion for placing over a horizontal support bar and an elongated upwardly extending leg which terminates in a point adjacent a hook portion in which it is received when pressed into its closed position.

U.S. Pat. No. 2,354,848 discloses a clip device for a fish stringer comprising a loop through which a string is received and secured, a generally U-shaped portion which has an upwardly extending leg that terminates in a pointed free end adjacent a hook portion in which it is received when pressed into its closed position.

U.S. Pat. No. 2,287,226 discloses a securing means to secure the fabric of an upholstered piece to a coil spring, comprising a thin strip of metal having a flat top or intermediate portion bent downwardly at one end with a pair of spaced apart curving hook-like arms which pierce the upholstery fabric, then draw it against the coil spring which is received between the spaced apart hook-like arms, the opposite end of the thin strip having a depending portion with a notch to slip over the facing portion of the coil spring.

U.S. Pat. No. 2,224,161 discloses a suspended support device made of a single strand of wire to form a pair of spaced apart hooks, spaced apart suspension members, a horizontal carrying member and a hook latch for releasably retaining and supporting the projecting end of the horizontal carrying member.

U.S. Pat. No. 2,168,076 discloses an upholstery staple having a pair of parallel legs connected at their inner ends by a U-shaped bridge which extends at right angles to the legs, one leg being relatively short terminating at a sharp point, the other leg being relatively longer and curving downwardly near its free end which then also terminates at a sharp point.

U.S. Pat. No. 1,875,628 discloses a tufting button comprising a combined ring and fastening clip formed of one piece, covering material over the ring portion, the fastening clip portion having an elongated leg terminating in a sharp point and a curved leg terminating in a hook to hook over the coil spring of an upholstered item after passing through the upholstery material.

U.S. Pat. No. 1,828,012 discloses a drapery pin having an elongated leg which terminates in a sharp point at its free end, is integrally joined to a loop at its opposite end, and a hook member extending from the opposite end of the coil having its hook end biased outwardly from the free end of the elongated leg which can be pressed toward the hook and received therein to close the drapery pin.

U.S. Pat. No. 1,608,705 discloses a fastening clip to connect a coil spring to an adjacent coil spring, comprising a continuous length of wire formed into a generally triangular shape, having one leg as the base integrally joined at one end to a first diagonally extending leg with the coil of one spring extending through the angle formed thereby, the base leg integrally joined at its opposite end to a second diagonally extending leg with the coil of a second spring extending through the angle formed thereby, the first and second diagonal legs terminating in cooperating hook portions to connect the two together.

U.S. Pat. No. 1,269,660 discloses a tatting hook and fastener, the fastener comprising a single strand of wire, a first leg terminating in a point at its free end, integrally joined to a loop at its opposite end, a second leg extending from the opposite side of the loop parallel to the first leg, the second leg terminating in a bent portion to provide a pair of laterally extending eyes, then a loop at right angles to the eyes and finally formed into a hook positioned adjacent the pointed free end of the first leg for reception by the hook.

U.S. Pat. No. 879,232 discloses a bale tie fastener comprising a continuous length of wire, a first leg having a free end, its opposite end integrally joined to a loop, a second leg extending from the opposite side of the loop which terminates in a hook at a location biased outwardly from the free end of the first leg which can be pressed toward the hook end of the second leg and received therein to close the tie fastener.

OBJECT OF THE INVENTION

The mattress clip in accordance with the present invention provide a single loop between an integrally joined laterally extending short leg which terminates in a hook at its free end and an integrally joined longitudinally extending longer leg which is integrally joined at its opposite end to a double loop, the double loop being integrally joined on its opposite side to a long leg which terminates in a sharp point at its free end biased outwardly from the hook of the first mentioned short leg and pressable toward the hook for reception therein. The single loop to which the laterally extending short leg is integrally joined is provided to receive the facing portion of an adjacent coil spring of an innerspring assembly to thereby secure any one or all of the other components of a mattress, such as the insulating pad or pads, the cushioning pad, and the fabric flange of the mattress cover, to an adjacent spring of the innerspring assembly.

The entrance to the single loop is the space between the ends of the laterally extending short leg and the longitudinally extending longer leg which are integrally joined to opposite sides of the single loop. Such ends are spaced apart a distance which is slightly less than the cross-sectional dimension of the wire which comprises the coil spring. Thus, the wire of the coil spring has to be forced past the corresponding ends of the short laterally extending leg and longer longitudinally extending leg which are integrally joined to opposite sides of the single loop to enter into the single loop, such ends being sufficiently resilient to spread apart enough to permit the wire of the coil spring to pass into the single loop after which the snap back to their original position. They thereby prevent the wire of the coil spring from inadvertently moving out of the single loop. It is locked in place within the single loop until such time as a person may desire to separate the mattress clip from the coil spring. At such time, sufficient force has to be applied to the mattress clip and coil spring in the direction of removal of the wire of the coil spring from the single loop to cause the ends of the short laterally extending leg and the longer longitudinally extending leg integrally joined to opposite sides of the single loop to spread apart enough to allow the wire of the coil spring to pass.

A mattress clip in accordance with the present invention eliminates the need for hog rings to secure the insulating pads, cushioning pads and fabric flange of the mattress cover to adjacent springs of the innerspring assembly, and the special tool needed to crimp the hog rings. Once they have been crimped they cannot be readily removed without damage. By using mattress clips in accordance with the present invention, persons not trained or experienced in assembling the component parts of mattresses may do so.

The innerspring assembly may last longer than one or the other of the insulating pads, cushioning pads or mattress covers. By use of mattress clips in accordance with this invention, home owners themselves can readily remove whatever mattress components need replacing from the innerspring assembly and replace with new.

It is another object of this invention to provide an assembled mattress using the mattress clips as described which has a border strip around the peripheral side wall of the mattress that can be opened and closed along one or both edges of the mattress covers on each opposite bearing side of the mattress. In one embodiment, a zipper assembly is secured along the peripheral edge of the mattress cover and the peripheral edge of the border strip which can be zipped open for access to the inner portions of the mattress and zipped shut to close.

In another embodiment, cooperative Velcro strips are secured to the peripheral edges of the mattress cover and of the border strip to enable opening and closing access to the inner portions of the mattress.

These and other advantages of the present invention will become apparent from the more detailed description which follows and from the accompanying drawings.

DESCRIPTION OF PREFERRED EMBODIMENT

Figure 1:
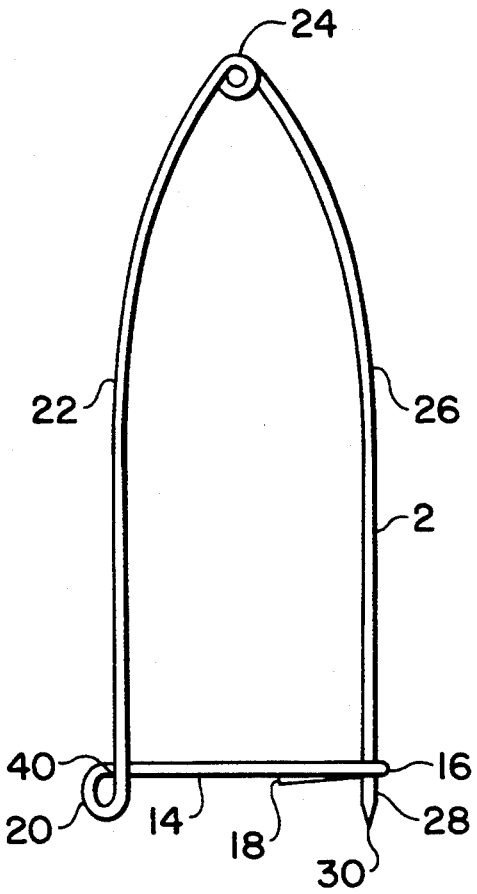
FIG. 1 is a side elevation view of a mattress clip in accordance with this invention.
Figure 2:
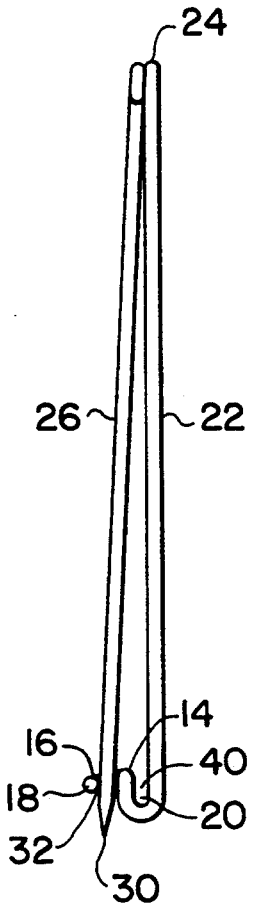
FIG. 2 is an end elevation view of the mattress clip shown in FIG. 1.
Figure 3:
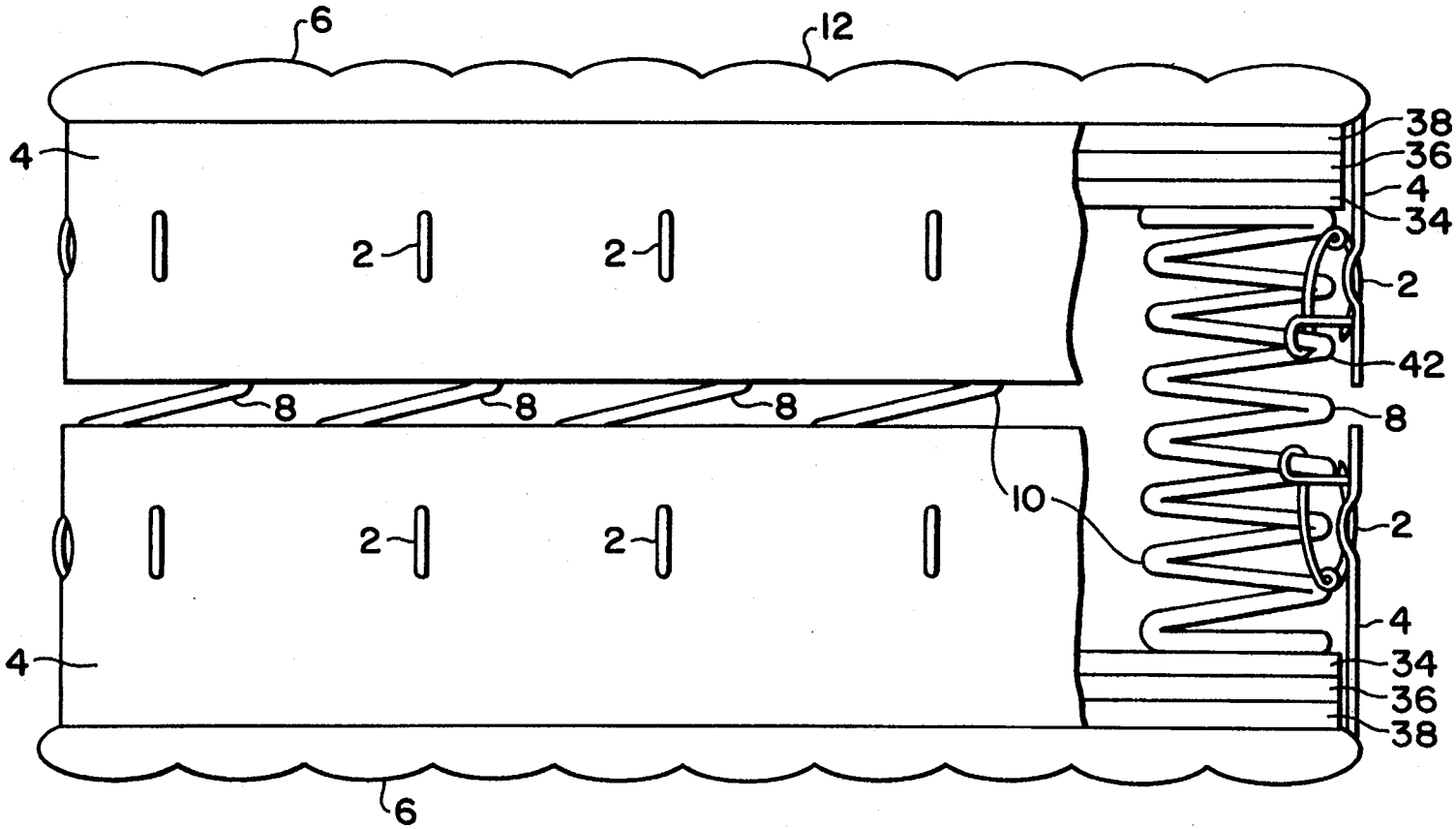
FIG. 3 is an elevation view of a mattress having the border strip removed and a portion of the fabric flanges of the mattress covers broken away to illustrate how the mattress clips secure the fabric flange to the adjacent coil springs.
Figure 4:
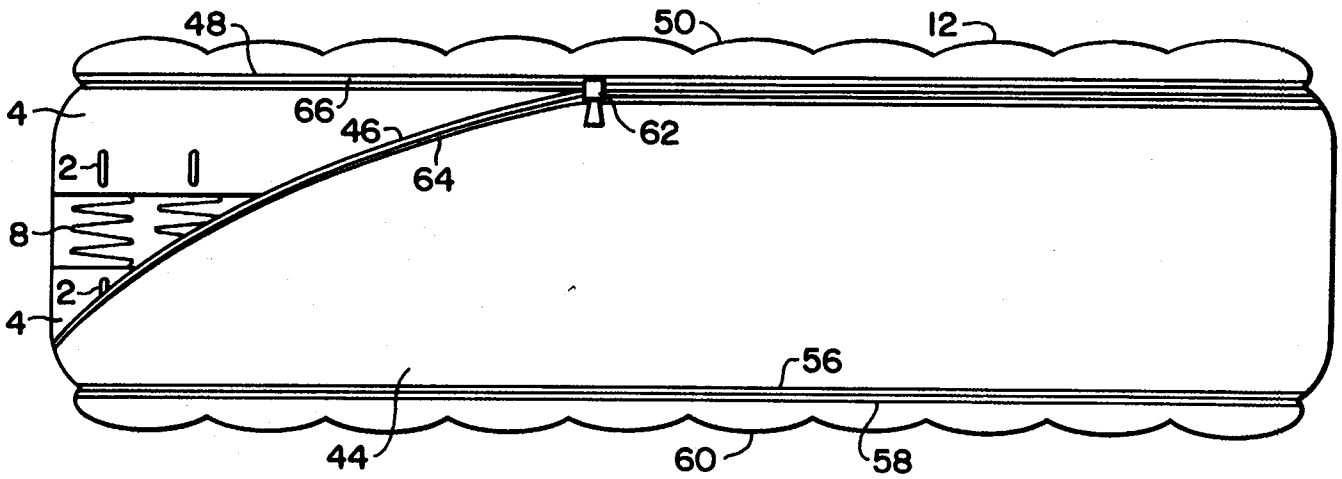
FIG. 4 is an elevation view of a mattress in accordance with this invention showing the border strip with a zipper assembly along its upper edge to open the border strip for access to the inner parts of the mattress.
Figure 5:
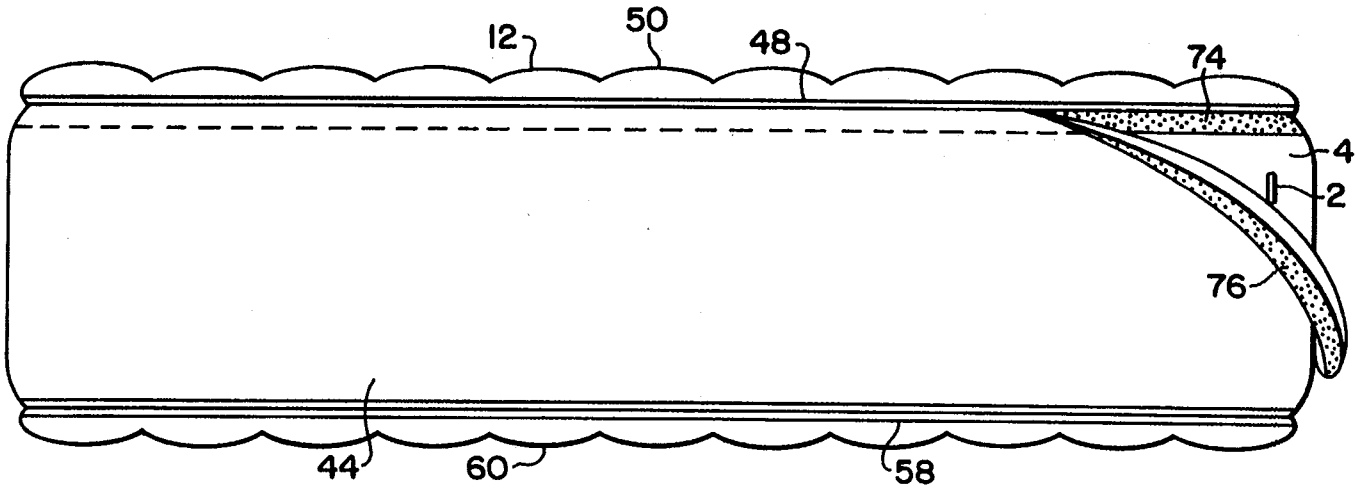
FIG. 5 is an elevation view of a mattress in accordance with this invention showing the border strip with Velcro type fastening strips along and adjacent to the upper edge of the border strip.

A mattress clip 2 is provided to secure the peripheral fabric flange 4 of the mattress cover 6 to individual coil springs 8 of the inner spring assembly 10 of a mattress 12.

The mattress clip 2 comprises a continuous length of wire having a spring characteristic, such as steel wire, which has been bent or otherwise shaped into a first relatively short length 14 which extends laterally from a hook portion 16 at its free end 18 to a single loop portion 20. The single loop portion 20 is integrally joined to a second relatively longer length 22 which extends longitudinally in a direction substantially normal to the first relatively short length 14. The second relatively longer length 22 is about two inches long in a preferred embodiment and the first relatively shorter length 14 is about a quarter of an inch long, the second length 22 thereby being about eight times longer than the first length 14.

The second relatively longer length 22 extends from the single loop portion 20 to a continuous double loop portion 24, integrally joined to the longer length 22 at one end of the double loop portion 24. The other end of the continuous double loop portion 24 is integrally joined to a third relatively long length 26 which is substantially the same length as the second relatively long length 22. The third long length 26 extends from its integral connection to the double loop portion 24 and terminates at its opposite free end 28 in a sharp point 30, which extends past the hook portion 16 and lies outwardly therefrom about an eighth of an inch in a preferred embodiment.

The spring characteristic of the wire biases the free end 28 of the third long length 26 outwardly from the hook portion 16, but permits pressing the free end 28 toward the hook portion 16 and far enough past the hook portion to be directed into the entrance 32 of the hook portion 16 whereupon it closes the mattress clip 2 and holds it in its closed position.

The mattress clip 2 is moved to its open position by pressing the free end 28 of the third long length 26 inwardly until it clears the entrance 32 of the hook portion 16 whereupon it springs back to its normally biased position outwardly from the hook portion 16.

The mattress clip 2 in accordance with this invention makes it possible to more easily assemble a mattress, to the point that a mattress can be assembled by the average homeowner and others who have not had special training and experience in assembling mattresses. The present and prior art method of assembling mattresses uses hog rings in place of the mattress clips 2 of the present invention, and a special tool is needed to secure the fabric flange 4 of the quilted mattress cover 6 to the coil spring 8.

To assemble a mattress, an inner spring assembly 10 of the desired dimension is first obtained, having a plurality of coil springs 8. Then insulators of various types such as a wire or polypropylene mesh 34 and a natural or synthetic fiber pad 36 is placed on top of the innerspring assembly 10, the corners of which are secured to adjacent ones of the coil springs 8 by mattress clips 2.

A polyurethane foam pad 38 is then placed on top of the insulators 34 and 36, whose corners are also secured to adjacent ones of the coil springs 8 by mattress clips 2.

The mattress cover 6 having the peripheral fabric flange 4 is then placed on top of the polyurethane foam pad 38 with the peripheral flange 4 extending down around the periphery of the innerspring assembly 10. The peripheral flange 4 is then secured to each adjacent coil spring 8 around the periphery of the innerspring assembly 10 by mattress clips 2.

The mattress clips 2 secure the fabric flange 4, as well as the insulators 34 and 36, and the polyurethane foam pad 38, to the coil springs 8 as follows. The third relatively long length 26 of the mattress clip 2 is placed on the inwardly facing side of the fabric flange 4, as well as of the insulators 34 and 36 and pad 38, with the sharp point 30 of its free end 28 in position to pierce through the fabric, then piercing through to the outwardly facing side, then piercing back through at a slightly spaced apart location to the inwardly facing side, then drawing the fabric snugly toward the adjacent coil spring 8, then positioning the entrance space 40 of the single loop portion 20, which spaces the facing end portions of the first short length 14 and second long length 22 of the mattress clip 2 apart, to receive the closest ring 42 of the adjacent coil spring 8 through the loop entrance space 40 to seat within the loop portion 20, then pressing the free end 28 of the third long length 26 toward and past the entrance 32 of the hook portion 16 and positioning it to enter the hook portion 16 thereby closing the mattress clip 2 and securing the fabric of the peripheral flange 4 of the mattress cover, as well as the corners of the insulators 34 and 36 and polyurethane foam pad 38, to adjacent ones of the coil springs 8 of the innerspring assembly 10.

The loop entrance space 40 has a dimension which is slightly smaller than the cross-sectional dimension of the rings 42 of the helical coil springs 8. The end portions of the first short length 14 and second long length 22 which face each other across the entrance space 40 are resilient enough to spread apart sufficiently to allow the ring 42 of the coil spring 8 to pass into the loop portion 20, after which the facing portions of the short length 14 and long length 22 snap back to their original positions to thereby retain the ring 42 of the coil spring 8 within the loop portion 20.

The partially assembled mattress is then turned over with the opposite side of the innerspring assembly 10 facing upwardly. The foregoing steps are then repeated, placing insulators 34 and 36 on top of that side of the innerspring assembly 10, securing the corners thereof to adjacent ones of the coil springs 8 using the mattress clips 2 as described above, then placing a polyurethane foam pad 38 on top of the insulators 34 and 36, securing the corners of the polyurethane pad 38 to adjacent ones of the coil springs 8, and finally placing a mattress cover 6 over the polyurethane foam pad 38 with its peripheral fabric flange 4 handing down around the periphery from that opposite side of the innerspring assembly 10, then securing such fabric flange 4 to each adjacent coil spring 8 around the periphery of the innerspring assembly 10 by using the mattress clips 2 as described.

To complete assembly of the mattress, a peripheral border strip 44 of fabric material is secured around the peripheral side wall of the innerspring assembly 10 to cover and enclose the fabric flanges 4 of the mattress covers 6 placed on both the upwardly facing and downwardly facing sides of the innerspring assembly 10. The border strip 44 has an upper peripheral edge 46 which is adjacent to the outer peripheral edge 48 of the mattress cover panel 50 over the upwardly facing side of the innerspring assembly 10, and a lower peripheral edge 56 which is adjacent to the outer peripheral edge 58 of the mattress cover panel 60 over the downwardly facing side of the innerspring assembly 10.

The lower peripheral edge 56 of the border strip 44 is sewn to the adjacent outer peripheral edge 58 of the mattress cover panel 60 which extends over the downwardly facing side of the innerspring assembly 10.

The upper peripheral edge 46 of the border strip 44 is not sewn to the adjacent outer peripheral edge 48 of the mattress cover panel 50 which extends over the upwardly facing side of the innerspring assembly 10 in the method of assembling a mattress in accordance with this invention. Instead, an elongated zipper assembly 62 extends around the periphery of the innerspring assembly 10, having one of its peripheral securing strips 64 secured to the upper peripheral edge 46 of the border strip 44 and the other of its peripheral securing strips 66 secured to the outer peripheral edge 48 of the mattress cover panel 50. This construction makes it possible to removably secure the upper edge 46 of the border strip 44 to the mattress cover panel 50, by zipping up the zipper assembly 62 to secure the border strip 44 to the mattress cover panel 50 and by unzipping the zipper assembly 62 to detach the upper edge 46 of the border strip 44 from the peripheral outer edge 48 of the mattress cover panel 50 for access to the inner portions of the mattress.

In lieu of the zipper assembly 62, a Velcro type fastener 72 may be used. A peripheral strip of tiny flexible hook members 74 is secured to the upper peripheral edge 46 of the border strip 44 and a peripheral strip of tiny flexible loops 76 is secured to the outer peripheral edge 48 of the mattress cover panel 50. The peripheral strip 74 when placed against the peripheral strip 76 releasably connects the border strip 44 to the mattress cover panel 50 thereby closing the peripheral side wall of the mattress. It may be opened by pulling the peripheral strip 74 away from the peripheral strip 76.

I claim:

1. A mattress clip to secure a portion of pierceable covering material to a connecting portion of an adjacent spring, comprising a resilient member of material having spring characteristics of being bendable from an original position under pressure and returnable to said original position when such pressure is released, said resilient member having a receiving portion to receive and retain said connecting portion of said adjacent spring therein, said receiving portion having an entrance space opening thereto between a first facing portion of said resilient member and a second spaced apart facing portion of said resilient member, said entrance space having a dimension between said first and second facing portions which is less than the cross-sectional dimension of said connecting portion of said spring to releasably retain it in said receiving portion when received therein, said first and second facing portions being sufficiently resilient to spread apart to enable said connecting portion of said spring to pass therethrough into said receiving portion and to snap back to their original positions when said connecting portion of said spring has been received in said receiving portion, said resilient member including a piercing portion to pierce a said portion of pierceable material and to extend therethrough for securing said pierceable material to said resilient member, said piercing portion being movable between a clip open position for piercing through a said portion of pierceable material and a clip closed position to secured said pierceable material to said resilient member when said connecting portion of said spring is received and retained in said receiving portion of said resilient member, including latch means to hold said piercing portion in its said clip closed position.

2. A mattress clip as set forth in claim 1, wherein said resilient member comprises a continuous length of wire, said receiving portion and its said entrance space being integrally formed as an integral part of said continuous length of wire, said piercing portion being integrally formed as an integral part of said continuous length of wire.

3. A mattress clip as set forth in claim 2, wherein said latch means to hold said piercing portion in its said clip closed position comprises a hook portion, said hook portion being integrally formed as an integral part of said continuous length of wire, said piercing portion comprising an elongated arm of said resilient member terminating in a sharply pointed free end, said elongated arm being positioned for hooking thereof near its said free end in said hook portion when moved to said clip closed position of said piercing portion, said free end of said elongated arm being normally biased to a position outwardly from said hook portion when said elongated arm is unhooked from said hook portion to move to said clip open position of said piercing portion.

4. A mattress clip as set forth in claim 3, wherein said hook portion is integrally formed at the free end of a first relatively short laterally extending arm, said receiving portion comprises a single loop having a first end integrally joined to said first relatively short laterally extending arm and a second end integrally joined to one end of a second relatively long longitudinally extending arm, including said second relatively long longitudinally extending arm, said first and second ends of said single loop being spaced apart to form said entrance space opening to said receiving portion, a double loop having a first end integrally joined to the opposite end of said second relatively long longitudinally extending arm and a second end integrally joined to said elongated arm of which said piercing portion is comprised at its end opposite its said sharply pointed free end.

5. A method of making a mattress including the first step of selecting an innerspring assembly having a plurality of compressible springs each having continuously joined compressible sections, such innerspring assembly having a first relatively broad bearing surface facing in one direction, a spaced apart second relatively broad bearing surface facing in the opposite direction, and a peripheral side wall extending around said innerspring assembly between said first and second bearing surfaces, the second step of placing said innerspring assembly on a support surface with said first bearing surface facing up and said second bearing surface facing down, the third step of selecting at least one insulating pad and placing it on said first bearing surface, the fourth step of securing each corner of said insulating pad to an adjacent one of said compressible springs with a said mattress clip as set forth in claim 1, the fifth step of selecting a cushioning pad and placing it over said insulating pad on said first bearing surface, the sixth step of securing each corner of said cushioning pad to an adjacent one of said compressible springs with a said mattress clip as set forth in claim 1, the sixth step of selecting a mattress cover having a peripheral fabric flange and placing it over said cushioning pad and said insulating pad on said first bearing surface with said peripheral fabric flange extending downwardly and around the periphery of said innerspring assembly in facing relationship with said peripheral side wall of said innerspring assembly, and the seventh step of securing portions of said peripheral fabric flange to an adjacent one of said compressible springs with a said mattress clip as set forth in claim 1.

6. A method of making a mattress as set forth in claim 5, including the eighth step of turning said innerspring assembly over with said second bearing surface facing up and said first bearing surface facing down, the ninth step of selecting at least one opposite side insulating pad and placing it on said second bearing surface of said innerspring assembly, the tenth step of securing each corner of said opposite side insulating pad to an adjacent one of said compressible springs with a mattress clip as set forth in claim 1, the eleventh step of selecting an opposite side cushioning pad and placing it over said opposite side insulating pad on said second bearing surface, the twelfth step of securing each corner of said opposite side cushioning pad to an adjacent one of said compressible springs with a said mattress clip as set forth in claim 1, the thirteenth step of selecting an opposite side mattress cover having a peripheral fabric flange and placing it over said opposite side cushioning pad and said opposite side insulating pad on said second bearing surface with said peripheral fabric flange extending downwardly and around the periphery of said innerspring assembly in facing relationship with said peripheral side wall of said innerspring assembly, and the fourteenth step of securing portions of said peripheral fabric flange of said opposite side mattress cover to an adjacent one of said compressible springs with a said mattress clip as set forth in claim 1.

7. A method of making a mattress as set forth in claim 6, including the fifteenth step of selecting a border strip of material to extend around the periphery of said innerspring assembly having a first peripheral edge to be placed adjacent the peripheral edge of said mattress cover over said first bearing surface of said innerspring assembly and having a spaced apart substantially parallel second peripheral edge to be placed adjacent the peripheral edge of said opposite side mattress cover over said second bearing surface of said innerspring assembly, the sixteenth step of placing the said second peripheral edge of said border strip adjacent said peripheral edge of said opposite side mattress cover over said second bearing surface of said innerspring assembly and securing it thereto, the seventeenth step of placing the said first peripheral edge of said border strip adjacent said peripheral edge of said mattress cover over said first bearing surface of said innerspring assembly, the eighteenth step of selecting an elongated zipper assembly of sufficient length to extend around the periphery of said innerspring assembly and having a first securing strip along one side of the zipper to secure to the said peripheral edge of said mattress cover which is over said first bearing surface and a second securing strip along the opposite side of the zipper to secure to the said first peripheral edge of said border strip, the nineteenth step of securing the said first securing strip of said zipper assembly to said peripheral edge of said mattress cover which is over said first bearing surface of said innerspring assembly, the twentieth step of securing the said second securing strip of said zipper assembly to said first peripheral edge of said border strip, and the twenty first step of joining the operating components of said zipper assembly at its starting end and zipping it up to releasably join said first peripheral edge of said border strip to said peripheral edge of said mattress cover which is over said first bearing surface of said innerspring assembly.

8. A mattress comprising an innerspring assembly having a first relatively broad bearing surface facing in one direction, a second relatively broad bearing surface facing in the opposite direction, a peripheral open side wall extending around said innerspring assembly between said first and second bearing surfaces, and a plurality of compressible springs each having continuously joined compressible sections, a first insulating pad over said first bearing surface having a first plurality of insulating pad corners a corresponding plurality of said compressible spring adjacent respective ones of said first plurality of insulating pad corners, a one of said mattress clips as set forth in claim 1 securing respective ones of said first plurality of insulating pad corners to corresponding adjacent ones of said plurality of compressible springs, a first cushioning pad over said first insulating pad having a first plurality of cushioning pad corners, a one of said mattress clips as set forth in claim 1 securing respective ones of said first plurality of cushioning pad corners to corresponding adjacent ones of said plurality of compressible springs, a first mattress cover over said first cushioning pad, said first mattress cover having a peripheral fabric flange extending laterally therefrom facing said peripheral open side wall extending around said innerspring assembly and facing adjacent ones of said plurality of compressible springs of said innerspring assembly, a one of said mattress clips as set forth in claim 1 securing said first peripheral fabric flange to respective adjacent ones of said plurality of compressible springs.

9. A mattress as set forth in claim 8, including a second insulating pad over said second bearing surface having a second plurality of insulating pad corners, a corresponding plurality of said compressible springs adjacent respective ones of said second plurality of insulating pad corners, a one of said mattress clips as set forth in claim 1 securing respective ones of said second plurality of insulating pad corners to corresponding adjacent ones of said plurality of compressible springs, a second cushioning pad over said second insulating pad having a second plurality of cushioning pad corners, a one of said mattress clips as set forth in claim 1 securing respective ones of said second plurality of cushioning pad corners to corresponding adjacent ones of said plurality of compressible springs, a second mattress cover over said second cushioning pad, said second mattress cover having a second peripheral fabric flange extending laterally therefrom facing said peripheral open side wall extending around said innerspring assembly and facing adjacent ones of said plurality of compressible springs of said innerspring assembly, a one of said mattress clips as set forth in claim 1 securing said second peripheral fabric flange to respective adjacent ones of said plurality of compressible springs.

10. A mattress as set forth in claim 9, including a peripheral border strip extending around the periphery of said innerspring assembly outwardly of said peripheral side wall extending around said innerspring assembly, said peripheral border strip having a first peripheral edge positioned adjacent to the peripheral edge around said first mattress cover, a zipper assembly connected between said first peripheral edge of said peripheral border strip and said peripheral edge around said first mattress cover whereupon said first peripheral edge of said peripheral border strip may be separated from said peripheral edge around said first mattress cover for access to the inner portion of said mattress, said peripheral border strip having a second peripheral edge positioned adjacent to the peripheral edge around said second mattress cover and secured thereto.

11. A mattress as set forth in claim 9, including a peripheral border strip extending around the periphery of said innerspring assembly outwardly of said peripheral side wall extending around said innerspring assembly, said peripheral border strip having a first peripheral edge positioned adjacent to the peripheral edge around said first mattress cover, a hook and loop fastening assembly connected between said first peripheral edge of said peripheral border strip and said peripheral edge around said first mattress cover whereupon said first peripheral edge of said peripheral border strip may be separated from said peripheral edge around said first mattress cover for access to the inner portion of said mattress, said peripheral border strip having a second peripheral edge positioned adjacent to the peripheral edge around said second mattress cover and secured thereto.

* * * * *